US007258729B1

(12) United States Patent
Barsimanto et al.

(10) Patent No.: US 7,258,729 B1
(45) Date of Patent: Aug. 21, 2007

(54) ELECTRONIC BI-POLAR ELECTROSTATIC AIR CLEANER

(75) Inventors: Albert Barsimanto, Martinez, CA (US); Maris Ambats, Martinez, CA (US)

(73) Assignee: Air Ion Devices Inc., Martinez, CA (US)

( * ) Notice: Subject to any disclaimer, the term of this patent is extended or adjusted under 35 U.S.C. 154(b) by 2 days.

(21) Appl. No.: 11/197,234

(22) Filed: Aug. 4, 2005

Related U.S. Application Data

(60) Provisional application No. 60/598,663, filed on Aug. 4, 2004.

(51) Int. Cl.
*B03C 3/155* (2006.01)

(52) U.S. Cl. ..... 96/66; 96/26; 96/68; 96/69; 96/77; 96/97; 96/226

(58) Field of Classification Search ..... 96/66–69, 96/75, 77, 95–99, 226, 227, 26; 95/901; 422/121
See application file for complete search history.

(56) References Cited

U.S. PATENT DOCUMENTS

| | | | | | |
|---|---|---|---|---|---|
| 2,593,377 | A * | 4/1952 | Wintermute | 95/70 |
| 2,822,058 | A * | 2/1958 | Roos et al. | 96/66 |
| 3,073,094 | A * | 1/1963 | Landgraf et al. | 96/66 |
| 3,108,865 | A * | 10/1963 | Berly | 96/66 |
| 4,072,477 | A * | 2/1978 | Hanson et al. | 95/71 |
| 4,477,263 | A * | 10/1984 | Shaver et al. | 95/7 |
| 4,828,586 | A * | 5/1989 | Joannou | 96/66 |
| 4,978,372 | A * | 12/1990 | Pick | 96/67 |
| 5,009,683 | A * | 4/1991 | Sun | 96/66 |
| 5,403,383 | A * | 4/1995 | Jaisinghani | 95/69 |
| 5,466,279 | A * | 11/1995 | Hattori et al. | 96/69 |
| 5,474,600 | A * | 12/1995 | Volodina et al. | 96/57 |
| 5,573,577 | A * | 11/1996 | Joannou | 96/66 |
| 5,593,476 | A * | 1/1997 | Coppom | 95/78 |
| 5,656,063 | A * | 8/1997 | Hsu | 95/58 |
| 5,695,549 | A * | 12/1997 | Feldman et al. | 96/55 |
| 5,702,507 | A * | 12/1997 | Wang | 96/55 |
| 5,733,360 | A * | 3/1998 | Feldman et al. | 95/78 |
| 5,807,425 | A * | 9/1998 | Gibbs | 96/66 |
| 5,846,302 | A * | 12/1998 | Putro | 96/66 |
| 5,855,653 | A * | 1/1999 | Yamamoto | 96/58 |
| 5,993,520 | A * | 11/1999 | Yu | 96/66 |
| 6,042,637 | A * | 3/2000 | Weinberg | 96/58 |
| 6,077,334 | A * | 6/2000 | Joannou | 96/66 |
| 6,312,507 | B1 * | 11/2001 | Taylor et al. | 96/19 |
| 6,471,752 | B1 * | 10/2002 | Lewis | 96/20 |
| 6,764,533 | B2 * | 7/2004 | Lobiondo, Jr. | 96/66 |
| 6,805,732 | B1 * | 10/2004 | Billiotte et al. | 96/66 |
| 6,955,708 | B1 * | 10/2005 | Julos et al. | 95/59 |
| 7,132,010 | B2 * | 11/2006 | Carlsson | 96/55 |
| 2004/0139854 | A1 * | 7/2004 | Rittri et al. | 95/70 |
| 2005/0045036 | A1 * | 3/2005 | Vetter et al. | 96/66 |
| 2005/0081719 | A1 * | 4/2005 | Carlsson | 96/223 |

* cited by examiner

FOREIGN PATENT DOCUMENTS

| | | | | |
|---|---|---|---|---|
| JP | 54-11571 | * | 1/1979 | 96/97 |

*Primary Examiner*—Richard L. Chiesa
(74) *Attorney, Agent, or Firm*—Larry D. Johnson

(57) ABSTRACT

An electro-mechanical electrostatic air cleaner that combines a low air resistance dielectric fibrous filter material positioned between and electrically charged by two electrically resistant carbon coated screens. The screens are charged by a remotely mounted bi-polar power supply. A pair of post ionization electrodes charge particles in the air with opposite charges, causing the particles to agglomerate. A plurality of screens may be placed in an array for increased one-pass filtration.

6 Claims, 4 Drawing Sheets

ELECTRONIC BI-POLAR ELECTROSTATIC AIR CLEANER

CROSS REFERENCE TO RELATED APPLICATIONS

The present application claims the benefit of the filing date of U.S. Provisional Patent Application Ser. No. 60/598,663, filed 4 Aug. 2004.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to air filters and air cleaners, and more specifically to an improved electrostatic-type air cleaner.

BACKGROUND INFORMATION AND DISCUSSION OF RELATED ART

Dust, pollen, smoke, smog, bacteria, virus, mold and odors are all comprised of particles which can be suspended in the air. These airborne particles are small, ranging in size from 0.001 microns to 10 microns. Larger particles of 10 to 50 microns tend to settle out quickly while smaller particles, the main hazard to health, remain airborne.

These suspended particles can be removed from the air by either mechanical or electrical means. The most common mechanical techniques include fan/filter systems, gravity settling, centrifugal separation, and scrubbing.

In ordinary fan/filter systems air is drawn through a filter which mechanically traps particles in a web of synthetic or glass fibers. The efficiency of these filters is dependent on the filter surface area and the density of the web network. At low air resistance densities, these filters are only effective for large particles exceeding 10 microns. Fan/filter systems may also involve activated carbon and/or silica gel materials to remove odors. The efficiency and effectiveness of these approaches are grossly limited, so that scents or perfumes are often used to make the filtered air smell "clean".

For small particle removal, a high efficiency, particle air (HEPA) filter having accordion-like pleats is used. These are expensive and used for special applications where a single pass efficiency is required, such as in hospitals and clean rooms, and they must be changed frequently before they become clogged and overburden the air circulation fan.

Electrical particle removal may be achieved by either electrostatic precipitation or open-air ion generation. Electronic deposition of particles is accomplished by charging the particles to be deposited with one polarity and grounding the objects on which the particles are to be deposited with the opposite polarity or common line ground.

The accepted theory of operation of a conventional electrostatic precipitation system involves air being drawn by a fan past an electrode that gives the airborne particles a relatively strong electric charge. The air then passes by a set of parallel collector plates of opposite charge to which the particles are attracted and stick. Essentially, electrostatic precipitation uses electrical forces of charged bodies to separate particles from the air where the polarization forces are perpendicular to the direction of the air flow. This process is highly effective on small airborne pollutants ranging in size from 0.001 to 10 microns (0.0000003 to 0.0004 inches).

A further issue involves the presence of free air ions. The air in typical indoor spaces is almost totally devoid of free air ions because any existing ions become attached to dust particles which then become attracted to and attached to nearby wall and floor surfaces. Thus the indoor air is essentially scrubbed free of nearly all free air ions, and there are no natural sources indoors to replace them. Outdoors, there are numerous sources of free air ions such as the effects of sunlight, waterfalls, ocean waves, and even pine forests.

Air ions function outdoors to naturally remove bacteria and small particles from the air, and their absence in indoor air can lead to easier spreading of infectious diseases. Air ions are also thought to affect moods, with an over-abundance of positive ions causing depression, and with a balanced level of free air ions being optimum for well-being.

U.S. Pat. No. 4,978,372 to Pick discloses a pleated charged media air filter for an electrostatic air filtration system of the charged media type wherein contact between the filter media and the electrostatic charging media of the filter is minimized or eliminated to increase the efficiency of the filter. The fibrous filter media is either corrugated to minimize its contact with the charging media or separated from the charging media by nonconductive spacers. This dramatically increases the efficiency of the filter by reducing the voltage drop on the charged media caused by conduction across a filter medium in close contact with both a charged and a grounded medium.

U.S. Pat. No. 5,474,600 to Volodina, et al. describes an apparatus for biological purification and filtration of air. The apparatus includes a coarse filter, an ionizer, an additional plate and a fine filter, which are installed in this order along the path of the gas flow, and a power source. The coarse filter is essentially an electrostatic precipitator consisting of three plates adjacent to each other, the outer-most of which are made of a cellular metal and are connected electrically to the opposite-in-sign terminals of the power source, whereas the central plate is made of polyurethane foam. The coarse filter abuts closely on the cylindrical nondischarge electrode of the ionizer.

U.S. Pat. No. 5,593,476 to Coppom teaches a method and apparatus for use in electronically enhanced air filtration. A high efficiency air filtration method and apparatus utilizes a fibrous filter medium that is polarized by a high potential difference which exists between two electrodes. The electrodes include an insulated electrode and an uninsulated electrode. A corona precharger is positioned upstream of the electrodes and filter. The corona precharger creates charged particles that have an opposite charge (e.g., a positive of negative charge) determined with respect to a polarization dipole proximal to the insulated electrode. These particles cancel a trapped charge that tends to accumulate on the filter surfaces proximal to the insulated electrode.

U.S. Pat. No. 5,855,653 to Yamamoto teaches an induced voltage electrode filter system with a disposable cartridge. A filter apparatus for trapping particles suspended in gaseous fluid stream generally includes a first and a second electrode with a porous filter therebetween along with electrical contacts for applying a DC voltage across the first and second electrodes. A third electrode is provided and a frame is included for removably supporting a porous filter, along with the first, second, and third electrodes in order to electrify, by induction, the third electrode with a voltage in the third electrode in order to increase trapping of the particles by the filter apparatus.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

SUMMARY OF THE INVENTION

The present invention relates to electrostatic precipitator filters in which the particle collecting element comprises a disposable fibrous dielectric material placed between two conductive screens, each of opposite polarity.

The inventive electrostatic precipitation air cleaner technology provides an inexpensive fibrous media placed in a bi-polarized electric field. The fibrous media becomes polarized by the electric field in the direction of the air flow, thereby attracting charged particles from the air to the fibrous media. This fibrous media has several times the collection capability and requires much less space than a conventional electrostatic precipitator. In addition, the fibrous network can secondarily function as a large particle filter, mechanically trapping the larger airborne particles, while maintaining low air resistance as required for all HVAC systems.

The filter efficiently collects uncharged small particles because the particles become electrically polarized when passing through the strong electric field between the plates of the filter.

In its simplest form the filter consists of a set of open screen conducting plates separated by a fibrous dielectric (i.e. non-electricity conducting) media such as loosely woven fiberglass, polyester or foam filter media.

An electric field is formed by imposing an opposite charge on the plates through a high voltage power supply. Typically, the voltage imposed is a total of 10-14 kilovolts with a current not exceeding 6 milliamperes with a total power consumption not exceeding 0.6 watts. The filter is then placed upstream of a fan and air drawn through it.

To augment the basic electrostatic approach an electrode may be placed upstream from the filter to charge incoming particles that would otherwise be neutral and remain as uncaptured pollutants. Such an electrode may take the form of activated carbon (to assist in gas removal) and/or fibrous material (to act as a large particle prefilter).

To further augment the basic approach a pair of downstream electrodes charge particles in the air with opposite charges, causing the particles to be attracted to each other and to agglomerate or grow larger, thus becoming easier to remove by filtration, or even becoming large enough to fall out of the air by gravity.

A major advantage of this bi-polar filter technology is the large increase in collection surface area of the fibrous media over a conventional set of flat parallel plates occupying the same space. The time between changing or cleaning the filter or plates, and the efficiency of this technology is well beyond that of conventional flat plate electrostatic precipitators.

In addition, the conventional precipitators, when dirty, tend to arc between the plates (thereby producing ozone) which is a potential fire/explosion hazard in volatile atmospheres and which limits their use in many installations. In contrast, the inventive bi-polarized device, when dirty, will form a closed circuit which may reduce the effectiveness of the filter, but not lead to arcing. The fibrous material is inexpensive and can be disposed of when contaminated whereas the conventional precipitator plates must be cleaned and reused, posing potential health hazard to the person handling the plates.

As with all electronic filters, efficiency may be reduced as relative humidity increases. However, the inventive bi-polar filter is less effected by humidity than are conventional electrostatic precipitators which have a propensity for arcing at high humidities, whereas the bipolar filter device will not arc under such conditions.

The inventive arrangement provides a configuration whereby air is simultaneously filtered (to remove both large and small particles—to 0.001 microns) and the air "treated" to:

a. Neutralize ambient static (and on non-conductive surfaces and objects). If a surface is negatively charged, it will attract the positive ions until it is neutralized, at which point it will no longer selectively attract ions of either polarity, thus remaining electrically neutral (discharged). This is useful for work stations in the semiconductor industry or any other static sensitive industry.

b. Prevent surfaces from attracting dust. By neutralizing the static electricity charges on surfaces, it prevents the surfaces from attracting dust. Thus the filter is useful in the photographic and printing industries where it furnishes clean dust-free air and in addition neutralizes the static electricity on film and other surfaces. This is also of great benefit in the plastics manufacturing industries where static electricity can be generated on the materials as part of the manufacturing process, such as when plastic films are passed rapidly over rollers etc.

c. Restore an increased level of balanced free air ions to the environment. The balanced free air ions restore a natural level of air ionization to indoor air, comparable to the levels found in clean mountain air outdoors. This has been shown to have numerous health benefits.

The net multiple effect of such a system has obvious benefits and multiple applications both for the occupants in the environment and more specifically, for the benefit of static sensitive equipment (such as computers). The inventive system may also have application in photo development labs, printing operations, semiconductor handling processes and in specific medical environments.

Accordingly, an object of this invention is to provide an air filter that is of elegant simplicity, compact, easy to install by the user, and which retrofits as a direct replacement for the ubiquitous, ordinary dust filter used in house furnaces and electrical air systems.

Another object of this invention is to provide the user with at least two options of different replacement filters: a permanent filter holder in which just the filter media is periodically replaced; and a fully disposable filter, frame and all, to minimize or eliminate physical contact with the collected matter.

Another object of this invention is to provide outboard visual monitoring using a neon light to confirm operation and/or to indicate that a filter change is required.

Another object of this invention is to provide a remote on/off switch to disengage the power source before replacing the filter.

Another object is to provide conductive screens which will not cause a static shock if touched directly. The preferred material provides conductivity with a minimum build-up of capacitance, has high electrical resistance properties, and may be used as a coating on polyester mesh screens. This renders the conductive plates "shockless" when touched even though they are at a high potential, and it also limits the current flow at any point in the filter should the filter become clogged with conductive material. In addition, the power supply itself is highly current limited so that it cannot supply enough current for arcing to occur.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a side elevation view of an activated charcoal core embodiment of the present invention, while

DETAILED DESCRIPTION OF THE INVENTION

Figure 1:
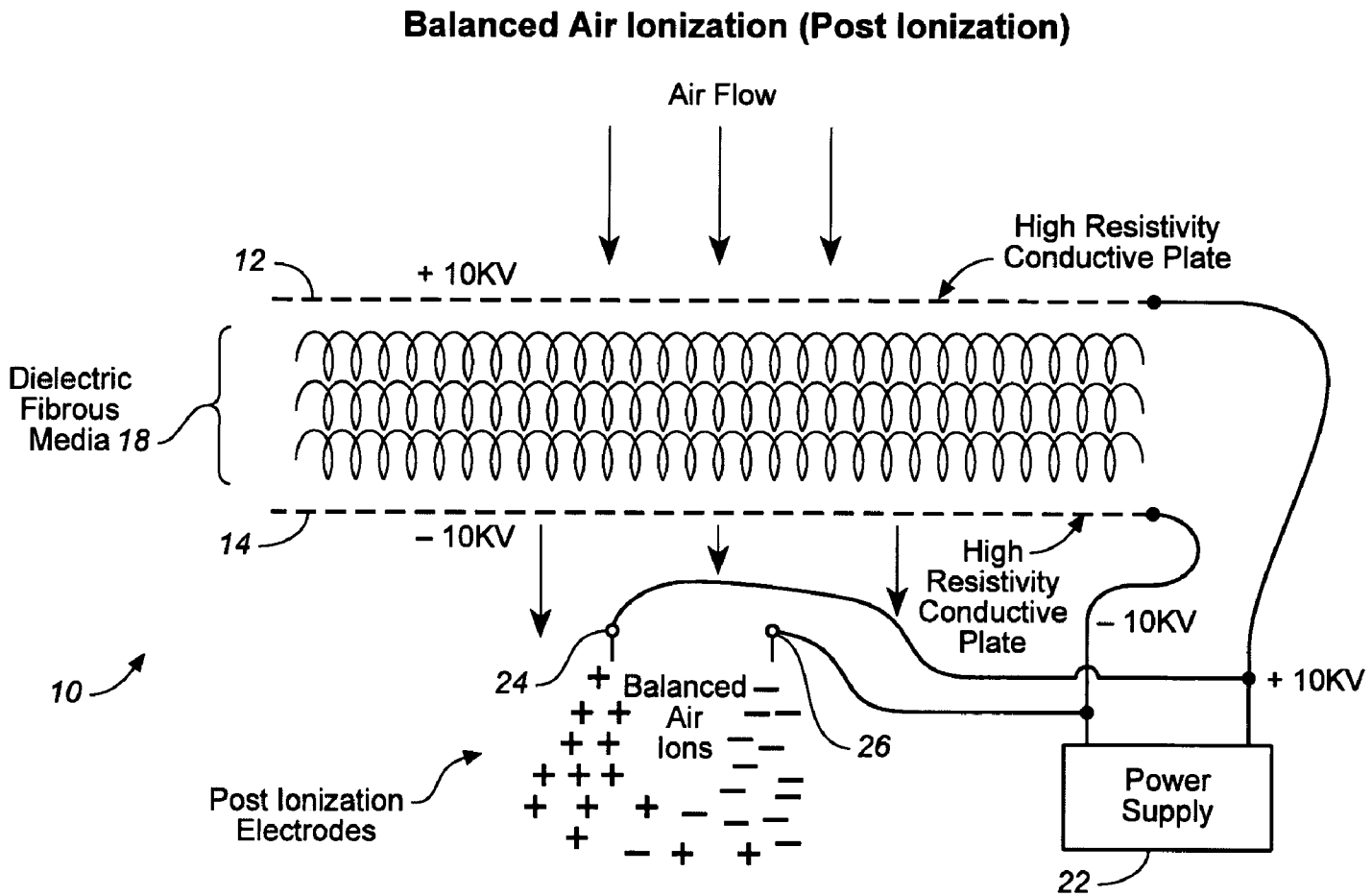
FIG. 1 is a side-elevation view of an electrostatic air cleaner of this invention.

Referring to FIGS. 1 through 4, wherein like reference numerals refer to like components in the various views, there is illustrated therein a new and improved electronic bi-polar electrostatic air cleaner, generally denominated 10 herein.

The inventive air cleaner apparatus 10 preferably includes a pair of conductive coated screens 12, 14 between which a dielectric media 18 is sandwiched. The screens are electrodes of opposite polarity (negative to positive or positive to negative). As air passes through the filter, small particles in the air stream are charged and attracted to the opposite polarity and lodge at random on the dielectric media surface 18 and held in place by the closed circuit of opposite polarity plates, and thus small particles are separated from the air stream. The electric charging of small particles causes rapid agglomeration, thus any particles that escape capture in the filter on the first pass, tend to get larger and are therefore more easily captured on a subsequent pass or fall out of the air by gravity.

The conductive screens 12, 14 are preferably plastic grids coated or treated with a carbon material which avoids capacitance build-up that could cause arcing under high voltage conditions, but is not limited to the use of high electrical resistance carbon. The electrical resistance material can be applied to a variety of certain plastic materials, fabrics, or even paper. The use of high electrical resistance material for the conductive plates provides the following benefits: acts as a reduced capacitance; can be used as a resistor; no static shock on touch; no arcing (or vastly reduced arcing potential); and the screens can be varied in size (e.g., from sizes 3"×3" in area to 25"×25" in area) with little or no increase in capacitance buildup as would be the case if normal carbon materials or solid metal materials were used.

A layer of steel wool, sharp conductive metal filings, or other material may be attached to the filter media 18 adjacent the upstream screen to intensify ionization, substantially improving collection efficiency in a single pass.

A carbon charcoal filter can be used as an electrode at one side or the other side or both sides. Electrifying a charcoal filter improves the residence time and efficiency for charcoal absorption of gasses attached to small particulate matter (e.g., carbon soot).

The power supply 22 produces equal values of opposite polarities to the respective plates for pre-fan filtration. The same power supply can provide post ionization through properly placed and spaced emitter electrodes 24, 26 to produce balanced ionization charged particles.

Figure 2:
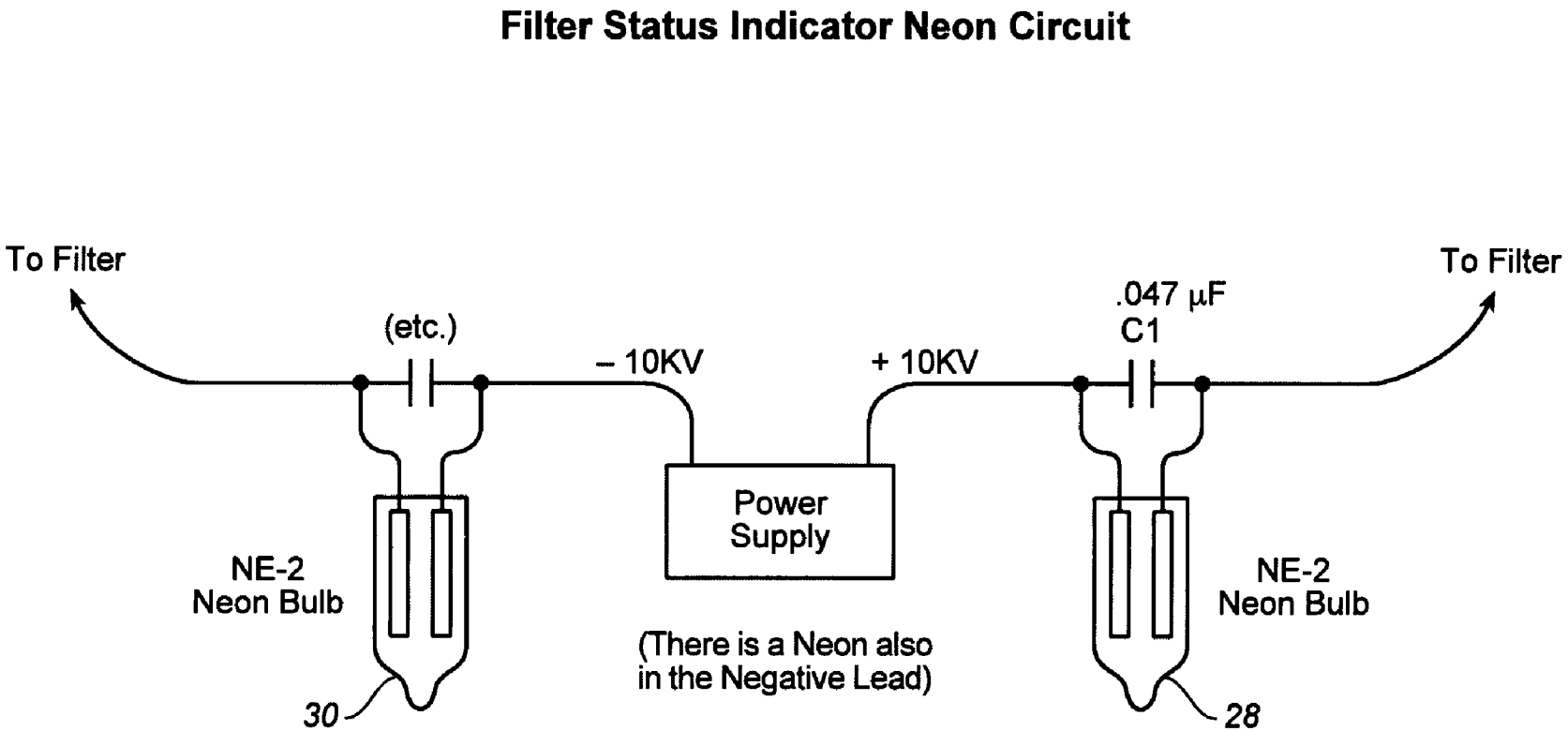
FIG. 2 is a schematic view of a neon circuit filter status indicator.

The power source is adapted to supply equal voltage for each polarity, e.g. between 5 KV and 14 KV. As illustrated in FIG. 2, a neon light array 28, 30 (one for each polarity) monitors output levels indicating the system is operating and when filter media should be replaced. As current flows from the power supply to the filter, the voltage builds up across the 0.047 mF capacitor C1. When the voltage across C1 builds up to approximately 100 volts, the neon bulb suddenly conducts, discharging the capacitor to approximately 70 volts and producing a pulse of light. This repeats at a rate dependent on the amount of current drawn by the filter. A filter with new clean fibrous media draws very little current and the neon bulb flashes very infrequently (e.g., on the order of once per minute to once per several seconds). As the fibrous media becomes dirty, the flashing rate increases to several times per second; indicating that it is time to change the filter media.

The inventive apparatus may include an output control—increasing or decreasing the output to provide optimal levels for varying thickness of filter media (e.g., 1" to 4").

High voltage leads from the remote power supply are attached to one of the opposite conductive screens and held in place by a frame. The leads are instantly detachable from the power source as well as from the frame.

The filter frame can be one of two different types: a permanent media holder which can be opened to remove a used filter and replaced with a new filter; or a fully disposable filter, frame and all, which can be burned as is the routine in hospitals where filters may contain bacteria.

While the basic system is 1" thick (to retrofit and convert the ubiquitous 1" dust filter to an electronic electrostatic filter), the principles apply to filters of any thickness, and allow a variety of "stages of processing" including but not limited to:

Basic: negative plate; dielectric, disposable media; positive plate.

Ground—pre filter; negative plate; dielectric media; positive plate; media to ground.

An ionization, pre-charge of the incoming air to a charcoal collector as a pre-filter followed by either of the above configurations.

While the preferred embodiment utilizes a 1" thick electrostatic precipitator filter for installation in HVAC systems, other embodiments of the invention may be used in self contained air moving systems. For example, the inventive system may also be used in self contained air cleaners/static neutral products, both small and compact or large sizes with air movement from 50 CFM to 300 CFM or more. A filter cartridge with a removable plate for filter media replacement may be used in such self-contained systems. The filter plates are charged as the cartridge is fully inserted into a connector and disengaged as the filter cartridge is removed. Thus, the user cannot touch a charged filter.

Figure 3:
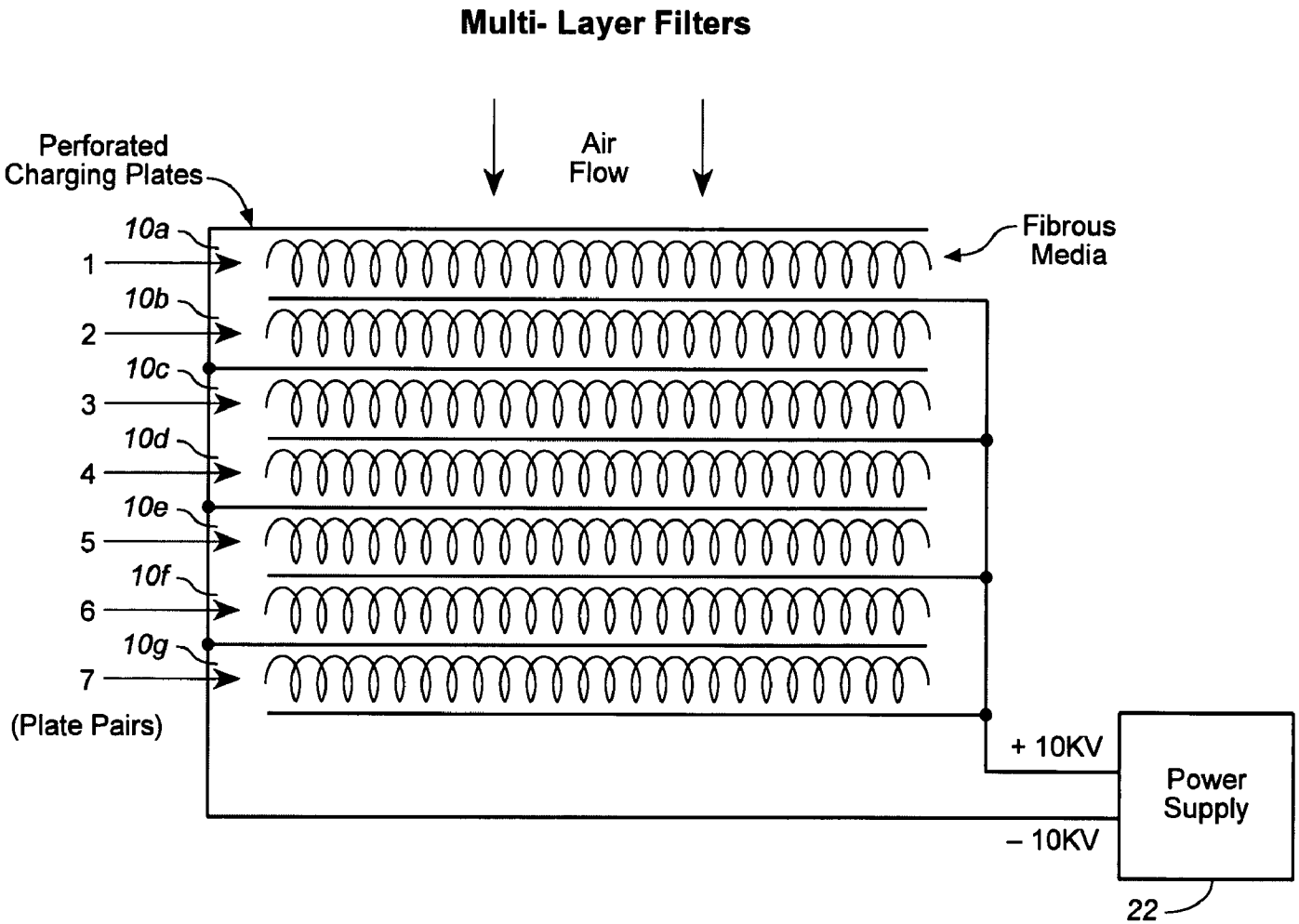
FIG. 3 is a side elevation view of a multi-filter arrangement.

FIG. 3 illustrates a multi-filter arrangement of the invention, wherein the filters are stacked in screen-to-screen juxtaposition. This stacked plurality of filters yields very high efficiency in removing small particles in a single pass—for hospital operating rooms, semiconductor clean rooms, etc. For example: the first pair of plates 10*a* may remove 75% of particles in a single pass. The second set of plates 10*b* removes 75% of the remaining particles (or 93.75% removal of total). The third set of plates 10*c* removes 75% of the remaining (98.438% removal); the fourth set of plates 10*d* removes 75% of the remaining (99.61% removal); the fifth set of plates 10*e* removes 75% of the remaining (99.90% removal); the sixth set of plates 10*f* removes 75% of the remaining (99.975% removal); and the seventh set of plates 10*g* removes 75% of the remaining particles (99.994% removal of total particles).

The fibrous material in the filter can be treated with a bactericide so that bacteria and viruses which are captured by the filter (since they are in effect very small particles) are thereby neutralized and cannot grow in the filter media despite high humidity conditions. This would be especially important for hospital and HVAC use. The germicidal effects of high voltage ionization are well known, thus the constant closed circuit in the inventive configuration has significant beneficial impact in "killing" pathogenic matter, especially in the range of 0.03 microns (e.g., viruses) within relatively short residence time of exposure to high, bi-polar voltage levels.

Figure 4:
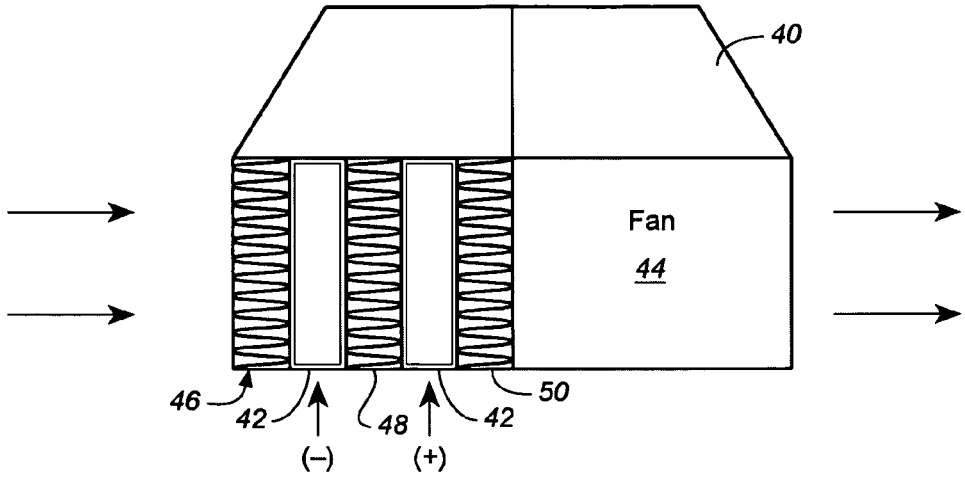

FIG. 4 is a side elevation view of an activated charcoal core embodiment of the present invention. This combines and integrates the functions of the inventive electrostatic precipitator system (for separation of small particles) with the function of activated charcoal (e.g., coconut shell) to absorb volatile organic compounds (VOCs) in the air stream.

The two major categories of elements in the air we breathe that pose hazards to our health are toxic small particles, sub micron in size, small enough to be inhaled directly into our lungs where it can and does cause damage, and volatile organic compounds, large molecules like PBDEs (fire retardant chemicals) that can attach to small particle matter (e.g., carbon soot) and be inhaled directly into our lungs.

In FIG. 4, the housing enclosure 40 is non-conductive and isolates the charcoal filtration cores 42 from the outside environment. Air is pulled or pushed through the enclosure by a fan 44 and through a sequence of filtration steps: pre-filter media 40, electrically activated charcoal filtration core 42 (e.g., negatively charged), ESP media filter 48, a second electrically activated charcoal filtration core 42 (e.g., positively charged), and post charcoal media filter 50. In function, the ESP stages separate small particle matter from the air stream, while the activated (and electrically activated) charcoal absorbs large molecules (VOCs) from the air stream.

Figure 4A:
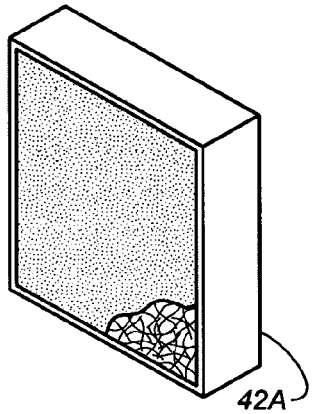
FIGS. 4A-4C are side elevation views of alternate cores.
Figure 4B:
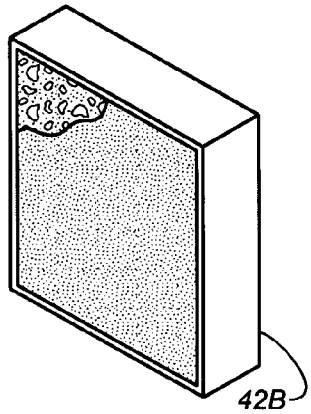
Figure 4C:
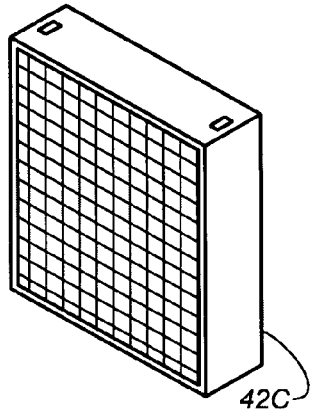

FIGS. 4A-4C are side elevation views of alternate cores, which in this configuration also operate as electrodes. All preferably utilize a coating with excellent electrical resistance properties and ability to reduce (control) the build-up of capacitance.

FIG. 4A illustrates a core 42A with a plurality of cardboard honeycomb cores that can be of varying sizes and thickness, that have been saturated or coated with the electrical resistance material. In this configuration there is a minimum of static air resistance. The core is durable and can be cold water washed or be disposable.

FIG. 4B illustrates a disposable core 42B with the honeycomb openings filled with small granules of activated charcoal. The openings on either side of the core are sealed with small pore nylon mesh to hold the charcoal material.

FIG. 4C illustrates a permanent housing enclosure 42C where all four sides are constructed of ABS sheet material and coated with electrical resistance material. The air openings are covered with grid electrodes with a small screen (e.g. fiberglass mesh) to contain the charcoal that fills the center opening. The top panel is removable so the charcoal can be replaced as necessary.

One embodiment of the invention provides an ion chamber isolated and insulated from line ground contact, which contains a dielectric barrier, a non-conductive spun glass collection filtering type media (preferred) in various sizes and thickness (2" to 4" preferred) which sits in the center of the chamber surrounded by four closed walls and two openings at which a coated plastic grid (electrode) is placed. Each grid is electrically charged with an opposing polarity (− to +, + to −) charging the entire surfaces of each grid, thus as air passes through the ion chamber each grid imposes an opposite polarity electric charge on either side of the dielectric media, creating a powerful "closed electrostatic loop" electrically charging and separating particles from the air stream where they are attracted to the opposite polarity and are deposited at random to surfaces inside and throughout the glass media, held in placed by the interaction of dual polarities where they cause rapid particulate agglomeration and attract and collect more particle matter.

In this method particulate dirt is densely collected and in greater volume over longer periods of time per cubic foot of space than if conventional flat metal plates were used as the collector.

Because the collecting media is non-conductive and because the non-metallic electrode grids spread the electric charge over the entire surface (and has very good electrical resistance properties) there is almost no buildup of capacitance, as there would be if using metal (tungsten wires as electrodes) any conductive-collecting surface, thus reducing the potential for sparking, arching producing ozone.

Whereas the conventional flat plate system begins at it's highest level of efficiency and rapidly decreases, in this new configuration collecting efficiency actually increases over time before requiring maintenance.

Removal disposal and replacement of spun glass collector is quick, hygienic and inexpensive. The system requires less frequent maintenance.

The bi-polar power supply is "self balancing-self adjusting" (will form a closed circuit) so that overtime, as dirt is collected in the dielectric collecting media, the opposing forces will diminish before arcing occurs reducing to minimal any ozone production.

The ion chamber housing is non-metallic composed of high impact and non-conductive ABS and vinyl extruded and ABS die cast parts.

In the preferred configuration (and with the nature of the good electrical resistance properties of the resistive coating), very high output levels of bi-polar ionization are practical and made possible. There is no static shock to the touch of one or both grids at the same time.

Because of the flexibility of the modular construction, different configurations can be manufactured in a wide range of shapes and sizes to retrofit virtually any duct (return air or supply) opening and/or to be combined with other components such as a fan (for the manufacture of small and very large room ESP air cleaners). Because the polarities can be utilized in an ESP configuration and simultaneously operate in open air, post fan ionization of either polarity, or both polarities, as in producing neutralizing static charges on non-conductive surfaces and/or for conditioning the ambient air stream, so as to balance ion levels in the air.

There is a further advantage to the inventive system. Conventional systems called "flat plate" are made with delicate metal collectors (attached to line ground) and an array of tungsten wire electrodes which electrically charge incoming air to separate particle matter from the air stream. There has been discovered a phenomena called silicon dioxide deposition whereby silicon in the air is attracted to the corona of the tungsten wire electrodes and is deposited on the wire and acts as an insulator, rapidly reducing the efficiency of the system and thus requiring frequent maintenance and/or replacement of the tungsten wire electrodes. The inventive system does not have this problem. The electrically resistive material coated on the plastic electrode grids does not create a focused corona, and thus does not produce silicon dioxide deposition as with conventional flat plate all metal ESP's, even though the output power levels of the new configuration may be more than 3 times greater (24 KV−/+) vs. 8 KV+to line ground. The inventive system uses less than 2 watts vs. 40 to 50 watts for the conventional system. Constructed of non-conductive (non-corrosive) high impact, non-corrosive, non-conductive materials, relative weight is 75% or less than the conventional all metal ESP, which may corrode over time.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. An air cleaner apparatus comprising:

a first conductive screen member;

a second conductive screen member;

a dielectric filter media material interposed between said first conductive screen member and said second conductive screen member to form a filter;

a power supply adapted to provide opposite polarity high voltage to said first and second conductive screen members; and a pair of post ionization electrodes adjacent said second conductive screen member, wherein when said power supply is activated and said first and second conductive screen members are polarized, small particles in an air stream passing through said air cleaner apparatus are charged and attracted to the opposite polarity and lodge at random on the dielectric filter media material and held in place by the closed circuit of opposite polarity screens, and said post ionization electrodes charge particles in the air with opposite charges, causing the particles to agglomerate.

2. The air cleaner apparatus of claim 1 wherein said first and second conductive screen members are coated with a carbon material to avoid capacitance build-up.

3. The air cleaner apparatus of claim 1 including a plurality of filters in screen to screen juxtaposition.

4. The air cleaner apparatus of claim 1 wherein said post ionization electrodes and said first and second conductive screen members are connected to the same power supply.

5. The air cleaner apparatus of claim 1 wherein said filter media is treated with a bactericide.

6. The air cleaner apparatus of claim 1 wherein said conductive screens include activated charcoal filtration to absorb large molecules from the air stream.

* * * * *